United States Patent [19]

de Angeli

[11] 4,422,636

[45] Dec. 27, 1983

[54] EXERCISE APPARATUS

[76] Inventor: Michael M. de Angeli, 12 Raymond Rd., Broomall, Pa. 19008

[21] Appl. No.: 160,614

[22] Filed: Jun. 18, 1980

[51] Int. Cl.[3] ..... A63B 21/06

[52] U.S. Cl. ..... 272/117; 272/134; 272/143; 272/DIG. 4

[58] Field of Search ..... 272/117, 134, 143, 144, 272/132

[56] References Cited

U.S. PATENT DOCUMENTS

| | | | |
|---|---|---|---|
| Re. 28,066 | 7/1974 | Marcyan . | |
| 2,855,199 | 10/1958 | Noland et al. | 272/117 |
| 3,072,400 | 1/1963 | Dykinga | 272/134 X |
| 3,120,954 | 2/1964 | Apostol | 272/117 |
| 3,640,527 | 2/1972 | Proctor . | |
| 3,708,167 | 1/1973 | Potgieter . | |
| 3,850,431 | 11/1974 | Winans . | |
| 3,858,873 | 1/1975 | Jones | 272/117 |
| 4,183,520 | 1/1980 | Chase | 272/130 |
| 4,200,279 | 4/1980 | Lambert | 272/118 |
| 4,200,280 | 4/1980 | Goodwin . | |
| 4,200,281 | 4/1980 | Wang . | |

FOREIGN PATENT DOCUMENTS

| | | | |
|---|---|---|---|
| 562038 | 5/1975 | Switzerland | 272/144 |
| 1405836 | 8/1975 | United Kingdom | 272/118 |

*Primary Examiner*—Richard J. Apley
*Assistant Examiner*—William R. Browne
*Attorney, Agent, or Firm*—Woodcock, Washburn, Kurtz, Mackiewicz & Norris

[57] ABSTRACT

An improved exercise apparatus is disclosed which features a bench mounted on a frame and having rigid rotatable arms mounted at opposing ends of the frame for exercise of groups of leg muscles and arm muscles respectively. Both rotatable members are connected to rotatable disks which have a plurality of attachment points disposed on opposite sides of their axes for connection of a weight bearing member so that the direction of rotation of the disk and of the point at which its rotation starts to do work can be varied whereby a large number of differing exercises can be performed with relatively simple apparatus.

5 Claims, 7 Drawing Figures

EXERCISE APPARATUS

FIELD OF THE INVENTION

This invention relates to the field of exercise apparatus in which variable quantities of weight are lifted by an athlete in pursuit of the goal of increasing strength and endurance, or for therapeutic or rehabilitative purposes. More particularly, the invention relates to exercise apparatus which provides significant versatility in the muscles or muscle groups which can be exercised, which uses a single set of weights for all exercises, which occupies limited floor space and requires minimal expense in its construction, all so as to be useful at the home of an individual athlete or in other limited-duty applications.

BACKGROUND OF THE INVENTION

For many years it has been common practice to increase one's strength and endurance or to speed recovery from an injury by doing work against a resistance force. Possibly the simplest apparatus for this purpose is bar- or dumbbells which are useful in the exercise of the arms and upper body. However, the use of dumbbells is not totally desirable because they are free weights; that is, the athlete is not constrained to use them in the most efficient possible manner. Moreover, there are safety considerations which militate against the use of such free weights.

An attempt at solving this problem was the development of the apparatus known as the "Universal Gym". This features a central station with a plurality of stacks of weights riding up and down on guide rods. The weights are lifted by the athlete through a complicated system of cables running over pulleys and, in the case of certain muscle groups, by lever action provided by rotation of a rigid rod. A comparable apparatus is shown in U.S. Pat. No. 3,850,431 to Winans. The lever action-type exercises are an improvement over barbells in that the path undergone by the exercised body portion during the exercise is defined by the rigidity and fixed pivot point of the lever, thus ensuring that the athlete will exhibit "good form" during his exercise. However, the Universal Gym and the Winans approaches, as described above, both also use flexible cables connected to handles. When exercising using these devices the athlete is not constrained to the proper or most efficient mode of exercise. Too, some desirable exercises, particularly those for the lower back, are not provided by either apparatus. Furthermore, the Universal Gym has not been designed to ensure efficient utilization of weights, so that if a complete exercise program is to be undergone using Universal Gym apparatus, a complete apparatus must be purchased which entails the purchase of duplicative quantities of weights, thus rendering it not suitable for home but more useful in the gymnasium environment, where a number of athletes may utilize the apparatus simultaneously. The Winans approach is meant to be economically feasible for home use, but lacks versatility in the exercises which can be performed.

More recently a new class of exercise apparatus has been available. This apparatus, sold under the tradename "Nautilus", comprises a series of machines, each designed to exercise one or, at most, two muscles or groups of muscles. The Nautilus machines are very elaborately designed and feature rigid members rotatable by the athlete in doing exercises so that good conformation is assured; the members generally pivot about the axis of the joint the muscles of which are being exercised. See, e.g., U.S. Pat. No. 3,640,527 to Proctor. Moreover, most of the Nautilus machines feature variation of the mechanical advantage provided to the athlete during the travel of the rotatable member through its arc. Such a machine is described in U.S. Pat. No. 4,200,279 to Lambert. This, it is stated, provides better exercise as compared to, e.g., the lifting of a barbell by an athlete exercising a bicep, wherein the work done against the force of gravity per degree of forearm rotation decreases as the athlete's forearm becomes more nearly vertical. However, as in the case of the Universal Gym, the very complexity of the Nautilus apparatus renders it entirely uneconomical for use by an athlete at home, since a complete Nautilus system comprises many machines, each costing several thousands of dollars and requiring a great deal of floor space. Accordingly, the Nautilus system, while of considerable utility, is impractical for use by a single athlete and therefore its use is confined to gymnasiums, health clubs, and the like wherein a plurality of athletes may be exercising at once.

Another possiblity for exercise apparatus is shown in U.S. Pat. No. 4,200,280 to Goodwin, which seems to correspond to that sold under the trade name "Bodybar". This apparatus comprises a vertical station comprising a track on which ride a selectable number of a set of weights which can be lifted by an athlete to exercise his upper body. Another such apparatus, featuring plural attachment points for handles, is shown in U.S. Reissue Pat. No. 28,066 to Marcyan. The Goodwin machine may also be provided with a cable and pulley arrangement for exercise of the legs. This suffers from the defects noted above with respect to the Universal Gym's use of cables and pulleys; that is, that the athlete is not constrained to follow the most efficient or safest path of exercise. Moreover, numerous important exercises such as those for the lower back referred to above are not made possible according to either the Goodwin or Marcyan schemes. See also U.S. Pat. No. 3,708,167 to Potgeiter, which has the same defects.

In addition to this prior art, all of which relates to various machines for providing a plurality of ways in which weights can be lifted against the force of gravity, exercise apparatus has also been shown in the prior art such as U.S. Pat. No. 4,200,281 to Wang in which effort is exerted against a resilient means, such as a spring or other flexible member, or against friction means. See also U.S. Pat. No. 4,183,520 to Chase. Such apparatus suffers from the extremely significant defect that it is impossible to measure the work done by the athlete. Inasmuch as precise measurement of the work done from day to day so as to regulate one's athletic output is essential to achieving the goals of a proper exercise program, such machines which provide plural ways in which to perform work against a resilient means are not suitable for the physical training of an athlete.

OBJECTS OF THE INVENTION

It is accordingly an object of the invention to provide an improved exercise apparatus.

A further object of the invention is to provide an exercise apparatus which is sufficiently inexpensive of construction and conservative of floor space that it is useful in the home of an athlete, but which provides exercise to all important muscle groups of the body.

A further object of the invention is to provide a home exercise apparatus which provides ways in which all major muscle groups can be exercised in a regimented and measurable fashion.

Still a further object of the invention is to provide a home exercise apparatus in which all major muscle groups can be exercised against the resistance transmitted through rigid rotatable members, pivoted substantially near the body joint being exercised, and in which varying mechanical advantage may be provided through the arc of rotation.

SUMMARY OF THE INVENTION

The present invention satisfies the above-mentioned needs of the art and objects of the invention by its provision of an exercise apparatus suitable for exercise of both the leg and arm muscle groups. Both groups are exercised through the rotation of rigid members, mounted at arm and leg exercise stations and rigidly connected to weights such that the work done by the athlete is conveniently and accurately measurable. However, the starting position of the rotatable arms with respect to the rest position of the weight may be varied so as to provide a plurality of different exercises at both the arm exercise and leg exercise stations. Moreover, the direction of rotation of the rigid arms which lifts the weight may be also be varied so that exercise of muscle groups not exercisable through utilization of prior art home exercise apparatus is possible. Moreover, inasmuch as exercises are performed by effort against rigid rotatable members, proper conformation of the athlete during exercise is assured; means are additionally provided for variation of the mechanical advantage provided to the athlete through the arc of rotation of the members.

BRIEF DESCRIPTION OF THE DRAWINGS

The invention will be better understood if reference is made to the accompanying drawings in which.

DESCRIPTION OF THE PREFERRED EMBODIMENT

Figure 1:
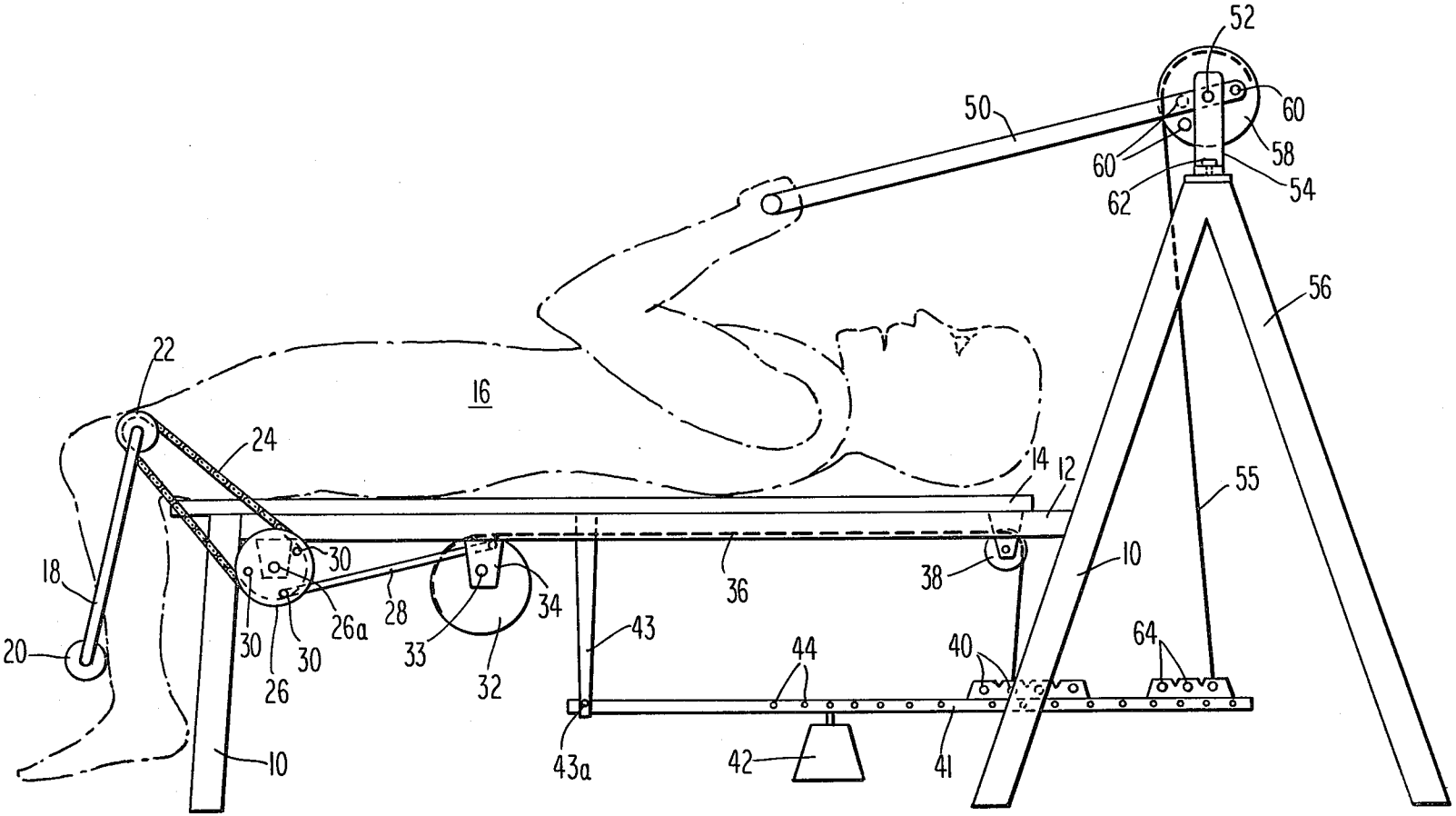
FIG. 1 represents an overall side view of the apparatus according to the invention.

If the reference is now made to FIG. 1, it will be observed that the apparatus of the invention comprises a bench comprising legs 10, a frame 12 and a top 14. An athlete indicated generally in phantom at 16 may sit or recline on his back or stomach on the bench for performing a variety of exercises. As shown, the athlete is simultaneously performing leg and arm exercises. Ordinarily this would not be done, but is shown for simplicity'sake. As shown, the leg exercise apparatus comprises a first rotatable arm 18, provided with a pad 20 to spread the load out over the athlete's body portion to prevent discomfort, which rotates about an axis indicated at 22. A roller chain 24 is driven by rotation of the arm 18 and in turn drives a rotatable disk 26. It is envisioned that the arm 18 may comprise a pair of arms, one on either side of the athlete's legs (as shown in FIG. 1) and connected by the pad 20 extending therebetween. The rotatable disk 26 is singular and preferably centered within the bench, while the chain 24 may be duplicated on both sides of the bench for equalization of stresses on the apparatus.

Rotation of the disk 26 by the athlete then causes a rod 28 pivotally fixed to the disk 26 at any of a plurality of locations 30, as discussed in further detail below, to rotate a second wheel 32 journaled upon a bracket 34, which in turn winds a cable 36 which may be a wire rope thereupon. The wire rope 36 passes over a pulley 38 and is pinned at one of a plurality of locations 40 to a bar 41 pivoted from a bracket 43 at a pivot **43*a*. A weight 42 may be attached in any of a plurality of locations 44 along the bar 41 to vary the effort put forth by the athlete in lifting the weight 42. It will be appreciated by those skilled in the art that selection of the point 30 at which the rod 28 is connected to the disk 26 controls the position of the arm 18 at which rotation thereof causes lifting of the weight 42 to commence and furthermore that if the connection point of the rod 28 is disposed, for example, on the opposite side of the axis 26*a* of the disk 26 from that shown in FIG. 1, the direction of rotation of the disk 26 which causes the weight 42 to be raised will be reversed. Such provision of, first, a variable rest position for the rotatable arm 18 with respect to the rest position of the weight 42**, and second, choice of the direction of rotation of the arm which causes the weight to be lifted, provides unprecedented flexibility in the exercises which can be performed using the apparatus of the invention, as will be detailed below in connection with FIGS. 2A–2C.

Disposed at the opposite end of the bench 14 from the leg exercising portion of the apparatus is a second rotatable arm 50 which rotates about an axis 52 supported on a yoke 54 carried on a support 56. As shown, the support 56 may comprise a leg 10 of the apparatus according to the invention but need not do so if deemed undesirable. Rotation of the arm 50 about its axis 52 causes rotation of a wheel 58. The wheel 58 shares the axis 52 of arm 50 and is connected to the arm 50 by means of a pin connected at one of a plurality of locations 60. Rotation of the wheel 58 winds a cable thereon, which lifts arm 41 from which weight 42 depends. As detailed above in connection with the disk 26, selection of the point 60 at which the arm 50 is fixedly connected to the disk 58 determines the starting position—that is, the position of the arm 50 at which the weight 42 begins to be lifted—as well as the direction in which the wheel 58 is rotated in order to lift the weight 42. Again, this yields great flexibility in the exercises which can be performed using the apparatus according to the invention. Additionally, the yoke 54 may be pivoted with respect to the support 56 by removal of a pin 62 and rotation of the yoke about a vertical axis. In this way, exercises can be performed on the opposite side of the bench from that shown in FIG. 1 to allow additional flexibility. It will be understood that by removing the pin 62, the yoke carrying the rotatable arm 50 and the wheel 58, to which is attached the cable 55, can be rotated to allow flexibility in the relative positioning of the arm 50 with respect to the bench 14. Again, the cable 55 rotated by the wheel 58 can be attached to a plurality of locations 64 along the arm 41 which supports the weight 42, to vary the overall mechanical advantage; the surface of the wheel 58 on which the cable 55 is wound can be formed in a cam shape, to provide variation of the mechanical advantage during rotation.

Figure 2:
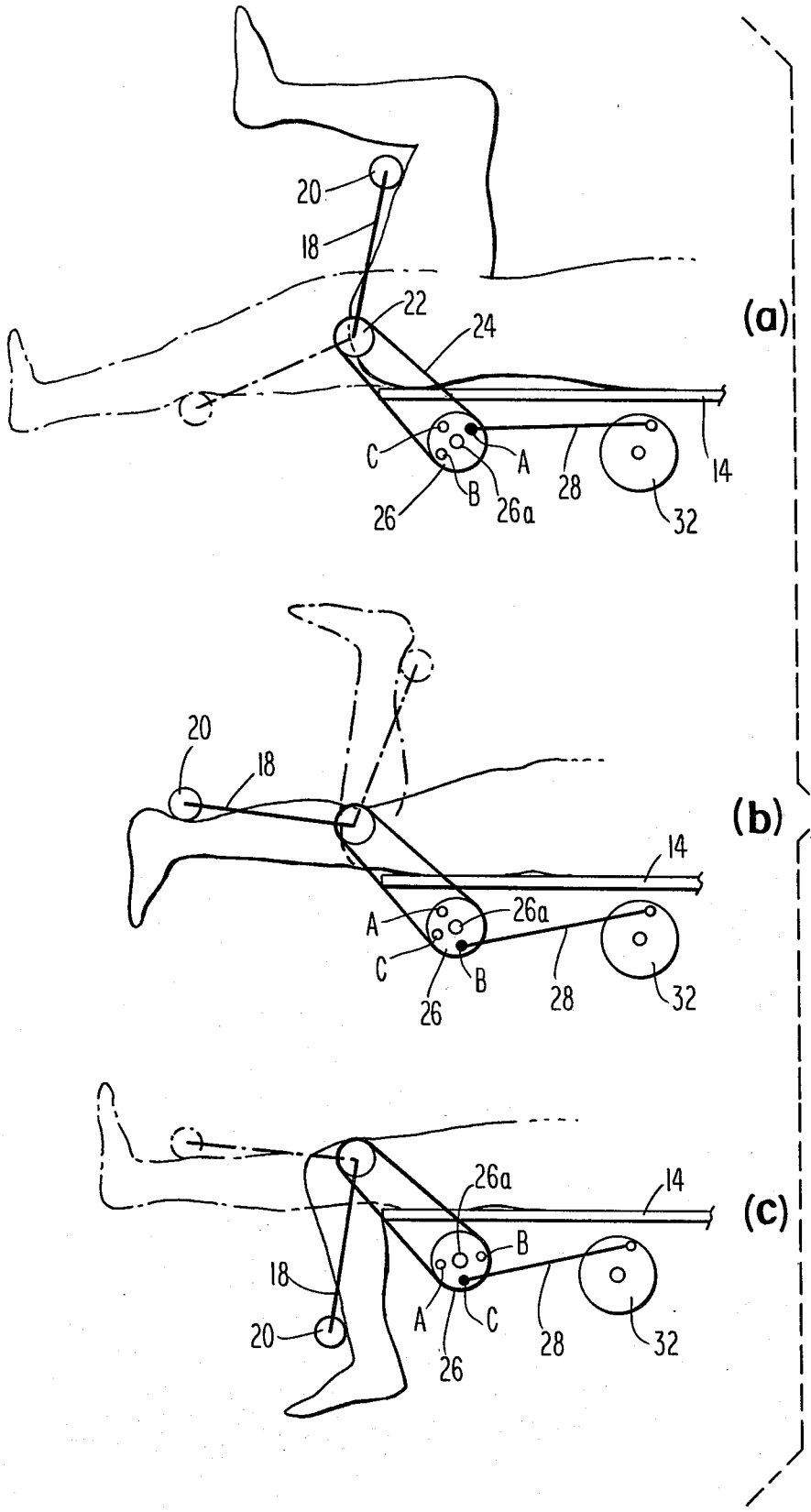
FIG. 2A–2C show various leg exercises possible with the apparatus of the invention.

Reference to FIGS. 2A–2C will make clear how the provision of multiple attachment points on the disk 26 provides increased flexibility in use of the apparatus of the invention. In each of FIGS. 2A–2C, the athlete is shown in full in beginning his exercise and in dotted lines at the conclusion of the exercise. In each case, he rotates the arm 18 by exertion of force thereon; in turn, the arm 18, being rigidly connected to a sprocket 22, causes the roller chain 24 to rotate the wheel 26. This in turn pulls the rod 28 which causes the wheel 32 to rotate. As detailed in FIG. 1, the wheel 32 has wrapped around its periphery a cable 36 which in turn lifts an arm 41 to which a weight 42 is attached.

In FIG. 2A, the athlete is shown exercising his buttock and lower back muscles. He positions his hip joint substantially in alignment with the axis of rotation of the arm 18. Thus the pad 20 is substantially under his knee. By rotation of his thigh downwardly, he does work against the weight, thus strenghthening the muscles mentioned. It will be noted that in FIG. 2A the rod 28 is attached to point A on the wheel 26.

If the athlete now desires to perform a different exercise, he disconnects the rod 28 from the wheel 26, e.g., by removing a rigid pin (shown as a dark dot) fitting through both, and rotates the arm 18 to a second position, for example as shown in FIG. 2B, and inserts the removable pin or other connecting means at point B on the wheel 26 thus attaching the rod 28 at that point. It will be appreciated that as connecting point B is disposed on the opposite side of the axis of rotation of wheel 26 from connecting point A, the direction of rotation of the arm 18 which causes lifting of the weight to occur is in the opposite sense from that shown in FIG. 2A. That is, in FIG. 2A counter clockwise rotation of the arm 18 lifts the weight whereas in FIG. 2B, clockwise rotation of the arm 18 lifts the weight. This is an important aspect of the present invention in that it provides great flexibility in the exercises which can be done. For example, in FIG. 2B, the athlete exercises his hamstring muscles by lying on his stomach, fixing the pad 20 behind his ankle and rotating the arm 18 in a clockwise direction.

In FIG. 2C the athlete has again altered the connection point of the rod 28 with respect to the wheel 26, but in this case, the direction of rotation remains the same; only the starting position of arm 18 with respect to the wheel 26 is varied. In this case, the athlete sits upright and the pad 20 is disposed on the front side of his ankle. By elevating his leg and rotating the arm 18 in a clockwise direction, he does work against the weight 42 (FIG. 1) and exercises the upper muscles of his upper thigh. This exercise is particularly useful for strengthening of the knee joint after injury to the ligaments or cartilage of the knee. Again, it will be noted that in both FIGS. 2B and 2C, the axis of rotation of the arm 18 is substantially aligned with the axis of the knee joint as it was with the thigh joint of FIG. 2A. It will also be appreciated that in accordance with the eccentric mounting of the wheel 32 with respect to its axis 33 (as shown in FIG. 1) variation in the distance the weight is lifted (i.e., the work done) per degree of rotation of the arm 18 varies throughout its arc in accordance with modern principles of physical conditioning and exercise. It will be appreciated that the ratio of the lengths of the distances of the attachment points of the rod 28 with respect to the axes 26A and 33 of the wheels 26 and 32, respectively, at any given time also affects the mechanical advantage at that time and hence the degree of exertion required to do work.

Figure 3:
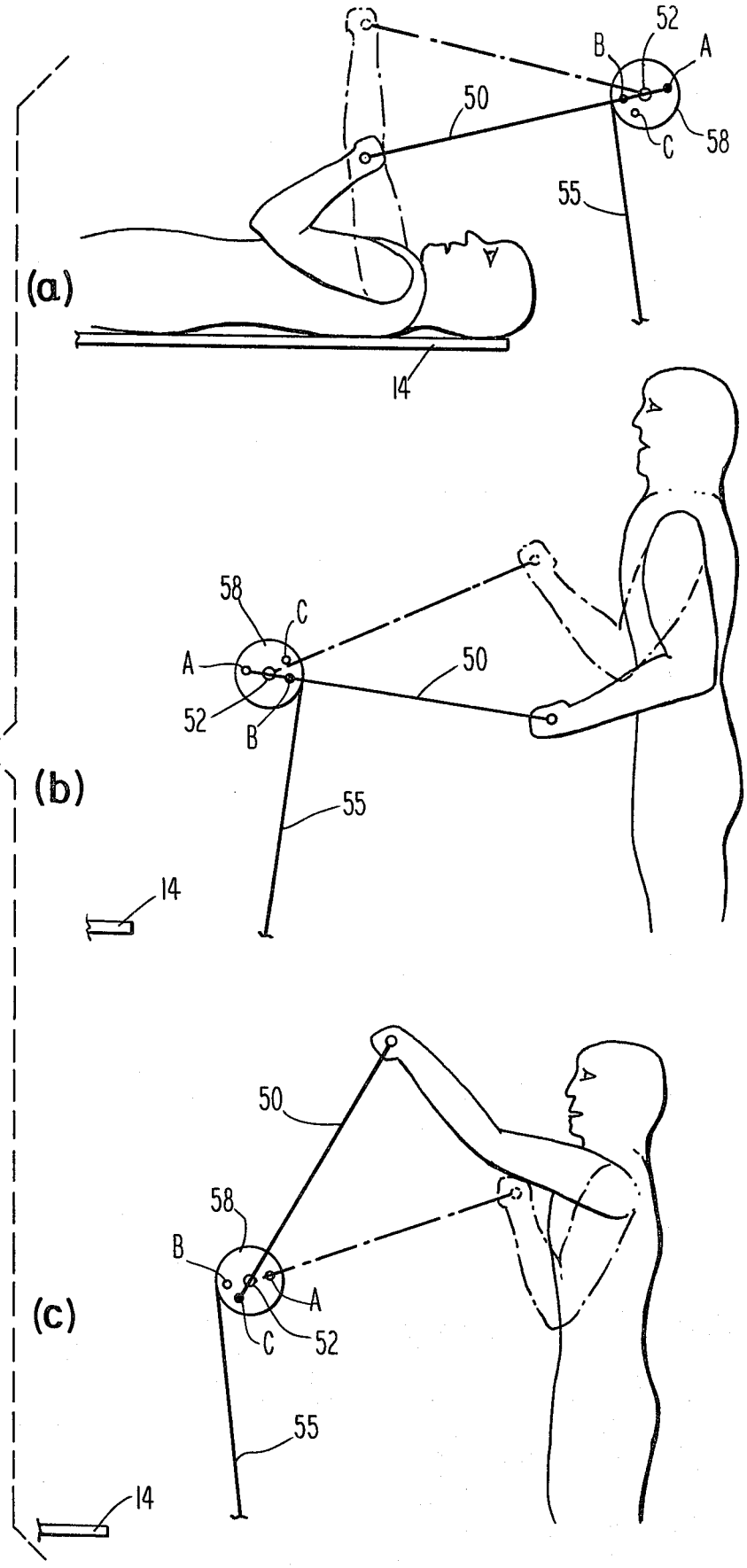
FIGS. 3A–3C show various arm and shoulder exercises possible with the apparatus of the invention.

Referring now to FIG. 3A–3C, three possibilities of exercise of the arms and upper body using the apparatus according to the inventions are shown. Other exercises are similarly possible but are not shown for simplicity's sake. In FIG. 3A, the conventional "bench press" is shown. There, the arm 50 is shown attached by a pin (again shown as a darkened dot) or the like at a first attachment point A on the wheel 58. The arm 50 is freely pivoted about the axis 52 of the wheel 58 and fixedly attached to the wheel at point A, so that by pushing the end of the arm 50 upward, the athlete does work by rotation of the disk 58 winding up of the cable 55 and attendant hoisting of the weight 42, as shown in FIG. 1.

By removing the pins 62 from the yoke supporting the disk 58 (FIG. 1) and rotating the yoke, disk and arm assembly substantially 180° as shown, the athlete reaches the position shown in FIG. 3B. Whether he then inserts a removable pin or the like at connecting point B or leaves it in place at connecting point A, he can continue to do work by rotating the arm 50 in the "up" direction since the direction of rotation of the disk 58 is the same as in FIG. 3A. The exercise shown is the popular "curl", useful for development of the biceps and chest muscles.

In FIG. 3C, the athlete is shown as having once again removed the pin 62 and rotated the yoke and disk assembly about 180°. In this case, the pin—that is, the point at which torque is exerted on the disk—is disposed on the opposite side of the axis of the disk from the athlete as compared with FIG. 3B. Accordingly, the athlete now pulls "down" on the arm 50 in order to do work on the weight 42. The exercise shown would tend to develop the triceps, back and neck muscles.

It will be appreciated that the rotation of the yoke 54 and disk 58 with respect to the bench 14 is not essential but may in some cases be a convenience both in allowing the athlete some freedom of stance without interference from the bench 14 and may also be useful in fitting the apparatus into a smaller floor space, since the yoke can be fixed at any convenient position so as to allow room for exercise. It will also be appreciated that as discussed above, the mechanical advantage provided to the athlete by the arm 50 can be varied throughout its arc by variation in the effective working radius of the disk 58. That is, it can be made eccentric or cam-shaped so as to change the distance from its axis at which the cable 55 is wound thereupon at any given point in its rotation. Furthermore, means can readily be provided so that the variation in mechanical advantage is invariant with respect to the starting point of the arm 50, by providing, for example, separate cam means and arm attachment means on a common pivot.

It will be appreciated that there has been described an apparatus for exercise which fulfills all the objects of the invention and needs of the art mentioned above. It is a comparatively compact, inexpensive and simple apparatus requiring but one set of weights to allow a plurality of exercises. All forces exerted by the athlete are exerted against rigid rotatable members so as to ensure proper conformation and safety in exercise, while allowing variation in the mechanical advantage provided to the athlete throughout the degree of rotation of the rigid member, in accordance with accepted muscular development practice. The provision of disks or other rotatable means having a plurality of attachment points for the connection of a load carrying member, while allowing rotation of the same rigid arm in both directions about its axis, permits the apparatus to provide versatility with regard to the number of different exercises possible, as rotation of the arms may start from a plurality of desired starting positions so as to exercise differing muscles or groups of muscles.

Moreover, it will be appreciated that while a preferred embodiment of the invention has been described above, the above description should not be considered as a limitation on the invention, as numerous modifications and improvements can be made thereon by those skilled in the art without departing from the essential scope of the invention. For example, while in the construction of the leg exercising apparatus of the invention shown in FIG. 1 an intermediate disk 32 has been provided, it is recognized that it would be possible to eliminate this disk 32 in favor of a direct cable connection between the rotating disk 26 and the cable 36 which ultimately hoists the weight 42. Another possibility would be to make the arm 50 used for exercise of the arm and chest muscles, in the shape of a loop. The athlete could then perform exercises such as those shown in FIG. 3B from a position within the loop—that is, with his back to the disk 50. This would allow closer alignment of the axes of the athlete's elbow and of the rotatable arm 50. It will likewise be understood that the term "athlete" is to be construed as including persons doing exercise for rehabilitative or injury-preventive purposes. Numerous other changes and modifications can likewise be made to the invention without departing from its essential scope, which is therefore to be construed to be limited only by the following claims.

What is claimed is:

1. Apparatus for the exercise of body members by the lifting of weight against the force of gravity, comprising:

a frame;

a bench mounted on said frame;

a first rotatable arm, mounted for rotation on said frame at an end of said bench to exercise leg muscles;

a second rotatable arm mounted on said frame for rotation for exercise of arm muscles; and a weight adapted to be elevated by rotation of either of said first or second arms;

wherein means are provided for operative connection of both said arms to said weight, said means for connection permitting variation of the position of said arms at which rotation thereof causes elevation of said weight to commence, and of the direction of rotation of said arms which elevates said weight, said weight being elevated from a rest position upon rotation of one of said arms, said means for connection permitting variation of said rest position with respect to the position of said arms at which rotation thereof causes elevation of said weight to commence, independent of the position of said arm at which maximum effort is exerted against the force of gravity.

2. The apparatus of claim 1 in which said means for connection permitting variation of the position of said arms at which rotation thereof causes elevation of said weight to commence comprises means mounted for rotation upon exertion of force on said arms, and provided with plural points of attachment to means for elevation of said weight.

3. The apparatus of claim 1 in which said means for connection permitting variation of the direction of rotation of said arms in which rotation thereof elevates said weight comprises disk means, mounted for rotation by exertion of a force on said arms, and provided with plural points of attachment to means for raising said weight upon rotation of said disk, said plural points being disposed on opposing sides of the axis of rotation of said disk with respect to the points at which rotation of said arms exerts torque on said disk means.

4. The apparatus of claim 1 including means for varying the distance said weight is raised by a given degree of rotation of said arms.

5. The apparatus of claim 4 wherein the axis of said second rotatable arm is substantially horizontal, and is furthermore adapted for rotation about a vertical axis with respect to said frame.

* * * * *